US009042755B2

(12) United States Patent
Rotberg et al.

(10) Patent No.: US 9,042,755 B2
(45) Date of Patent: May 26, 2015

(54) PRINTER CONTROL USING OPTICAL AND ELECTROSTATIC SENSORS

(71) Applicant: Xerox Corporation, Norwalk, CT (US)

(72) Inventors: Eric Rotberg, Toronto (CA); Richard Philip Nelson Veregin, Mississauga (CA); Majid Kamel, North York (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/046,018

(22) Filed: Oct. 4, 2013

(65) Prior Publication Data

US 2015/0098718 A1 Apr. 9, 2015

(51) Int. Cl.
*G03G 15/00* (2006.01)
*B41J 29/393* (2006.01)

(52) U.S. Cl.
CPC ..... *B41J 29/393* (2013.01)

(58) Field of Classification Search
USPC ..... 399/38, 46, 49, 50, 51
See application file for complete search history.

(56) References Cited

U.S. PATENT DOCUMENTS

| | | | | |
|---|---|---|---|---|
| 5,119,131 | A | 6/1992 | Paolini et al. | |
| 5,264,948 | A | 11/1993 | Imoto | |
| 5,270,660 | A | 12/1993 | Werner, Jr. et al. | |
| 5,550,653 | A | 8/1996 | TeWinkle et al. | |
| 5,680,541 | A | 10/1997 | Kurosu et al. | |
| 6,512,898 | B2 * | 1/2003 | Funatani | 399/49 |
| 7,379,684 | B2 * | 5/2008 | Julien | 399/49 |
| 8,213,816 | B2 | 7/2012 | Kozitsky et al. | |
| 8,422,899 | B2 | 4/2013 | Ramesh et al. | |
| 2012/0183316 | A1 | 7/2012 | Tabb et al. | |

* cited by examiner

*Primary Examiner* — Hoan Tran
(74) *Attorney, Agent, or Firm* — Gibb & Riley, LLC

(57) ABSTRACT

Various methods and devices transfer test patches of marking material from a marking device of a printing apparatus to a transfer surface of the printing apparatus, optically measure the density of the test patches on the transfer surface using an optical sensor of the printing apparatus, and measure the electrostatic differences in charge of the transfer surface as the test patches on the transfer surface move by an electrostatic sensor of the printing apparatus. Such methods and devices adjust settings of the marking device based on output from the electrostatic sensor alone, or based on a combination of the output from the optical sensor and converted output from the electrostatic sensor.

23 Claims, 5 Drawing Sheets

PRINTER CONTROL USING OPTICAL AND ELECTROSTATIC SENSORS

BACKGROUND

Systems and methods herein generally relate to controlling printer operations and more particularly to using electrostatic sensors, potentially in combination with optical sensors, to control printer settings.

Printers deal with many different input items and adjust for changes in printing operations over time. One process of adjusting the settings of the printer is referred to as adjusting the tone reproduction curve (TRC). The TRC calls for different amounts of different colors to be used in different situations.

Many printers use optical sensors to test printing and adjust the TRC. These optical sensors, commonly called automatic density sensors (ADC), work by shining light on a toner patch on a photoreceptor or intermediate transfer belt (ITB) and recording the specular and diffuse reflections. Depending on the type of toner and/or sensor, either one of the reflections or a combination of both, are used to generate an optical signal. The sensitivity of the optical signal to changes of toner mass on the photoreceptor or ITB is low for solid patches of toner, but increases for less dense (e.g., halftone) patches.

Therefore, some printers use several halftone patches to adjust the TRC for halftones and interpolate the setting for the solid patch. This interpolation can lead to solid densities being out of control and can vary widely. Solid densities become dependent on several variables that can affect development, such as tribo charge of the toner, toner age, environmental conditions etc.

SUMMARY

Exemplary printing devices herein include an intermediate transfer belt (sometimes more generically referred to herein as a "transfer surface") operatively (meaning directly or indirectly) connected to a processor and a marking device also operatively connected to the processor. The marking device is adjacent the transfer surface and transfers test patches of marking material to the transfer surface. An electrostatic sensor is operatively connected to the processor. In addition, in some embodiments herein, an optical sensor can be used and also placed adjacent the transfer surface to optically measure the density of the test patches on the transfer surface.

The electrostatic sensor (which can be used alone or in combination with the optical sensor) is adjacent the transfer surface and measures electrostatic voltage of the transfer surface as the test patches on the transfer surface move past the electrostatic sensor (by, for example, detecting an electrostatic voltage difference between the transfer surface with and without a test patch to determine an electrostatic value of each of the test patches). The electrostatic sensor can be any form of sensor that detects the electrostatic voltage of the transfer surface, such as a non-contact electrostatic voltmeter (ESV) and is therefore referred to as an ESV at some points in the following description.

When the ESV is used in combination with the optical sensor, the processor develops an "ESV sensor response ratio" between the ESV sensor response for a relatively more dense patch and a relatively less dense patch combined with a response of the optical sensor for the relatively less dense patch (e.g., a halftone test patch). The processor tests relatively less dense test patches using output from the optical sensor, but tests relatively more dense test patches using output from the ESV sensor. The test patches comprise various densities of halftone test patches and solid test patches, and the output from the electrostatic sensor is used to test the solid and dense halftone test patches and the output from the optical sensor is used to test the less dense halftone patches.

The processor converts the output from the ESV sensor into "converted output" using the electrostatic sensor response ratio. The processor adjusts the settings of the marking device by determining a tone reproduction curve (TRC) for the marking device. Thus, the processor adjusts settings of the marking device based on output from the ESV sensor alone or, if the ESV sensor is used in combination with the optical sensor, a combination of the output from the optical sensor and the converted output from the ESV sensor. For example, the processor adjusts settings of the marking device by changing the charge level of the latent charge, discharge light level and/or bias voltage, etc., used by the marking device during printing.

Various methods herein transfer test patches of marking material from a marking device of a printing apparatus to a transfer surface of the printing apparatus and measure the electrostatic differences in charge of the transfer surface as the test patches on the transfer surface move past the electrostatic sensor of the printing apparatus. For example, such methods measure the electrostatic charge by detecting an electrostatic voltage difference between the transfer surface with and without a test patch to determine an electrostatic value of each of the test patches.

Such methods can also optically measure the density of the test patches on the transfer surface using an optical sensor of the printing apparatus. These methods can develop a "ESV sensor response" ratio between the electrostatic sensor response for a relatively more dense patch and a relatively less dense patch combined with a response of the optical sensor for the relatively less dense patch (e.g., a halftone test patch) using a processor of the printing apparatus. Such methods test relatively less dense test patches using output from the optical sensor, and test relatively more dense test patches using output from the ESV (using the processor). The output from the optical sensor is used to test the halftone patches when testing relatively less dense test patches, and the output from the ESV is used to test the solid test patches when testing relatively more dense test patches.

Such methods then convert the output from the electrostatic sensor into converted output using the electrostatic sensor response ratio, and adjust settings of the marking device based on a combination of the output from the optical sensor and the converted output from the ESV (using the processor). When adjusting the settings of the marking device, such methods determine a tone reproduction curve (TRC) for the marking device. Thus, when adjusting such settings of the marking device, these methods can change the charge level of a latent charge, discharge light level and/or bias voltage, etc.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

Figure 1:
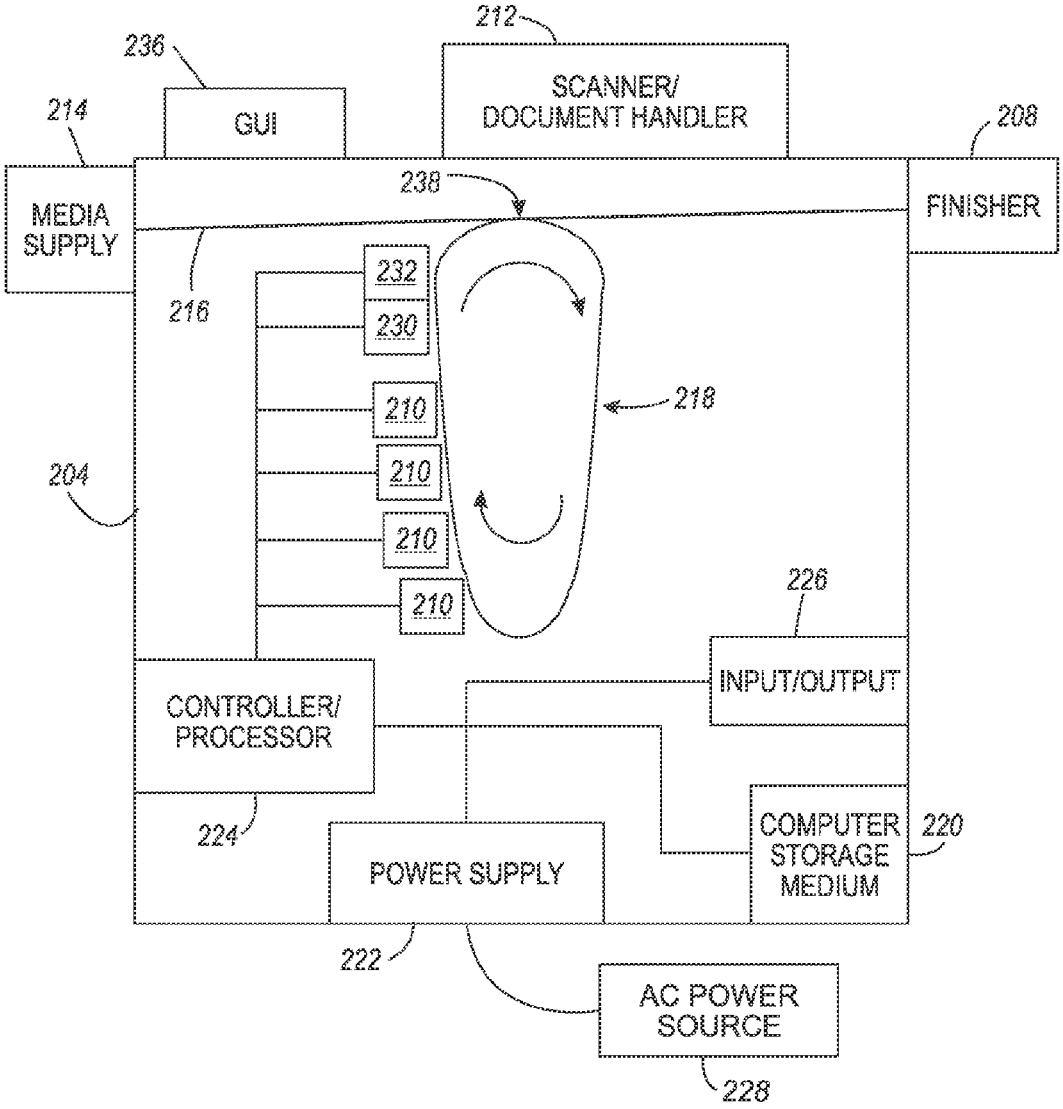
FIG. 1 is a schematic diagram illustrating devices herein.

As mentioned above, the sensitivity of the optical signal to changes of toner mass on the photoreceptor or ITB is low for solid and high density halftone patches of toner, but increases for less dense (e.g., halftone) patches. Therefore, some printers use several halftone patches to adjust the TRC for halftones and interpolate the setting for the solid patch. However, this interpolation can lead to high densities being out of control and can vary widely.

For example, test patches can use 100%, 80%, 60%, 40%, and 20% halftone values. If an optical sensor becomes saturated above 60% halftone (for example) the remaining values may simply be extrapolated. However, the present toner or printer conditions may only be detrimentally affecting 80% and above halftones, and these poor printing conditions would not be detected by the optical sensor testing the 60% and below halftone patches.

Therefore, the systems and methods herein provide methods that use an electrostatic sensor (such as a non-contact electrostatic voltmeter (ESV)) to measure the difference in electrostatic voltage between a clean transfer surface and toner patch on the transfer surface. The electrostatic sensor can be used alone or in combination with an optical sensor (as discussed below). Thus, the ESV can be used alone for all test patches (including the low density halftones) without using an optical sensor. The use of an electrostatic sensor alone, provides a simplified/cost efficient way to control TRC in many situations.

Additional methods combine the use of an ESV and an optical sensor. The ratio between the electrostatic sensor response for a solid (or high density halftone) patch and a control halftone patch, combined with the response of the optical sensor for the same control halftone patch is used to determine the amount of toner present on the solid patch when both the optical and electrostatic sensors are used.

More specifically, the devices and methods herein use an electrostatic sensor (e.g., ESV) to measure the electrostatic voltage on a transfer surface (one example of which is an intermediate transfer belt (ITB)) as control patches on the transfer surface move by the electrostatic sensor (as the ITB rotates around its supporting rollers). The voltage difference between a clean belt voltage and a patch voltage is used as the voltage signal. This can use a single sensor or multiple sensors, as shown below.

Additional embodiments herein also can use the electrostatic sensor in combination with an optical sensor. This uses an optical sensor where it is most sensitive (to control the halftone test patches) and uses an electrostatic sensor where it is most sensitive, to control solid test patches. An exemplary equation is presented below to link the optical sensor response to the ESV response. This provides high precision control across the entire TRC (solids and different density halftones) independently of tribo-charge and toner type/composition.

Thus, when both an electrostatic sensor and an optical sensor are used, the electrostatic sensor response ratio is used to calculate optical density as shown in the following equation where TMA represents the test patch density and ESV represents the output of the electrostatic sensor.

$$TMA_{solid} = \frac{ESV_{solid}}{ESV_{halftone}} TMA_{halftone} \quad (1)$$

In one example, the electrostatic sensor can be placed very close to the ITB (e.g., ~1 mm) and can be positioned in a location to allow a printed patch to be first detected by the optical sensor and then, as the ITB moves, the ESV. The voltage difference between a clean transfer surface containing no patches and a transfer surface containing a patch accurately provides an electrostatic voltage independent of tribo charge of the toner layer. This difference in voltage can be due to the insulative effect of the toner. The more toner on the photoreceptor, the higher the insulation relative to the back side of the intermediate transfer belt (the side contacting the rollers) and the bigger the voltage signal. In addition, this voltage signal is independent of color (except black) and can be used for clear toner as well. Because black toner is significantly more conductive than others, the voltage signal is lower.

FIG. 1 illustrates a computerized device that is a printing device 204, which can be used with methods herein and can comprise, for example, a printer, copier, multi-function machine, multi-function device (MFD), etc. A controller/processor 224 controls the operations of the printing device 204 according to instructions stored within a tangible, non-transitory computer storage medium 220. Further, the printing device 204 can communicate with other devices and networks through an input/output device 226.

The printing device 204 includes at least one marking device (printing engine or marking station) 210 operatively connected to a processor 224 and positioned adjacent a transfer surface 218 (e.g., intermediate transfer belt or other device for transferring patterned toner to print media, etc.). Such marking devices 210 can pattern any form of marking material (e.g., toners, inks, etc.) whether currently known or developed in the future on the transfer surface 218. The transfer surface 218 transfers the marking material patterned by the marking devices 210 to print media (e.g., paper, cardstock, plastics, metals, alloys, glasses, woods, etc.) traveling along a media path 216 at the transfer location 238.

The media path 216 is positioned to supply continuous media or cut sheets of media from a media supply 214 to the transfer surface 218. After receiving various markings from the transfer surface 218 at the transfer location 238, the sheets of media can optionally pass to a finisher 208 which can fold, staple, sort, etc., the various printed sheets. Also, the printing device 204 can include at least one accessory functional component (such as a scanner/document handler 212, graphic user interface 236, etc.) that operates on the power supplied from an external power source 228 (through a power supply 222).

Thus, the transfer surface 218 is operatively (meaning directly or indirectly) connected to a processor 224 and a marking device 210 also operatively connected to the processor 224. The marking device 210 is adjacent the transfer surface 218 and transfers test patches of marking material to the transfer surface 218. Also, an optional optical sensor 230 and an electrostatic sensor 232 are operatively connected to the processor 224. The optical sensor 230 is adjacent the transfer surface 218 and optically measures the density of the test patches on the transfer surface 218.

The electrostatic sensor 232 may be used alone or in combination with the optical sensor 230 and is adjacent the transfer surface 218 and measures electrostatic voltage of the transfer surface as the test patches on the transfer surface 218 move past the electrostatic sensor 232 as the transfer surface 218 moves (as indicated by the arrows in the drawings). For example, the electrostatic sensor 232 detects an electrostatic voltage difference between the transfer surface with and without a test patch to determine an electrostatic value of each of the test patches.

In one example, the optical sensor can be a simple infrared light and sensor, a full width array (FWA) sensor of charge coupled devices (CCD), or any other type of optical sensor. In one example, the electrostatic sensor 232 can be an electrostatic voltmeter (ESV) sensor or any other type of electrostatic voltage sensing device. Such an electrostatic sensor 232 measures charge change as text patches on the transfer surface 218 move past the electrostatic sensor 232 (as the transfer surface 218 moves) to sense marking material density (based on the electrical insulation provided by the marking material).

Figure 2:
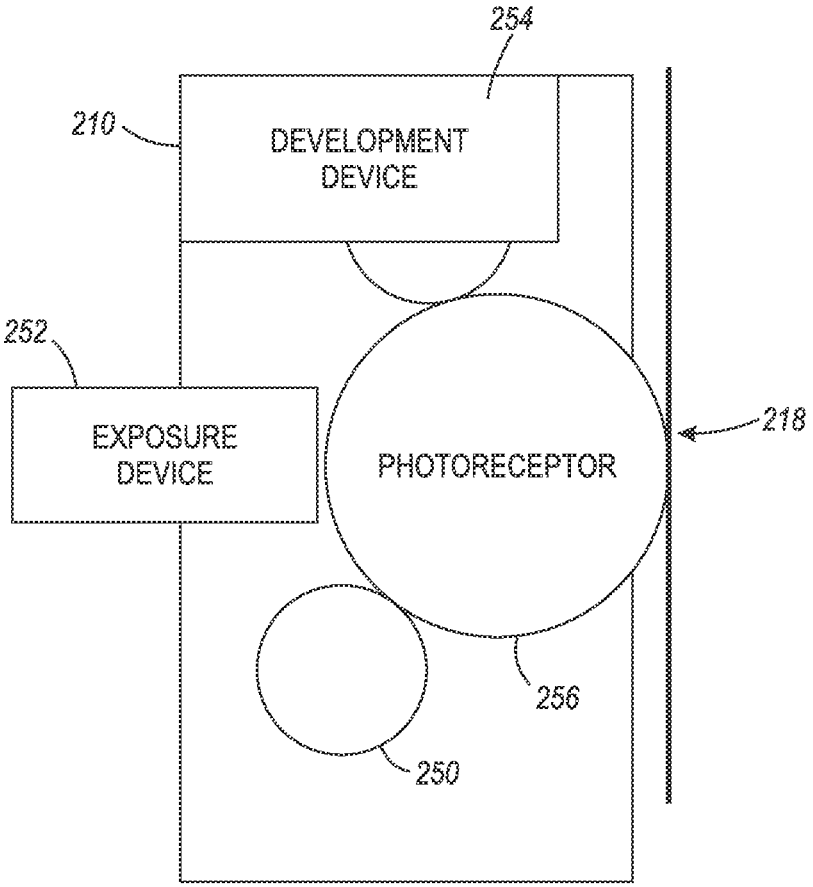
FIG. 2 is a schematic diagram illustrating devices herein.

As shown in greater detail in FIG. 2, the marking device 210 includes a charging device 250 (e.g., a blanket electrostatic charging device) forming a blanket charge on a photoreceptor 256, an exposure device 252 (e.g., a light source, etc.) patterning the blanket electrical charge on the photoreceptor 256, and a development device 254 (marking material delivery device) transferring marking material to the photoreceptor 256 (all of which are operatively connected to the processor 224). The charging device 250 and exposure device 252 form a patterned latent charge on the photoreceptor 256. The development device 254 supplies marking material to the photoreceptor 256 and the marking material is patterned on the photoreceptor 256 by the latent charge.

When the electrostatic sensor 232 is used in combination with the optical sensor 230, the processor 224 develops an "electrostatic sensor response" ratio between the electrostatic sensor 232 response for a relatively more dense patch and a relatively less dense patch combined with a response of the optical sensor 230 for the relatively less dense patch (e.g., a halftone test patch)

The processor 224 tests relatively less dense test patches using output from the optical sensor 230 (if so equipped) but tests relatively more dense test patches using output from the electrostatic sensor 232. The test patches comprise various densities of halftone test patches and solid test patches, and the output from the electrostatic sensor 232 is used to test the solid test patches and more dense halftone patches and the output from the optical sensor 230 is used to test the less dense halftone patches.

The processor 224 converts the output from the electrostatic sensor 232 into converted output using the electrostatic sensor response ratio. The processor 224 adjusts the settings of the marking device 210 by determining a tone reproduction curve (TRC) for the marking device 210. Thus, the processor 224 adjusts settings of the marking device 210 based on output from the electrostatic sensor 232 alone, or based on a combination of the output from the optical sensor 230 and the converted output from the electrostatic sensor 232. For example, the processor 224 adjusts settings of the marking device 210 by changing the charge level of the latent charge used by the marking device 210 during printing.

Figure 3:
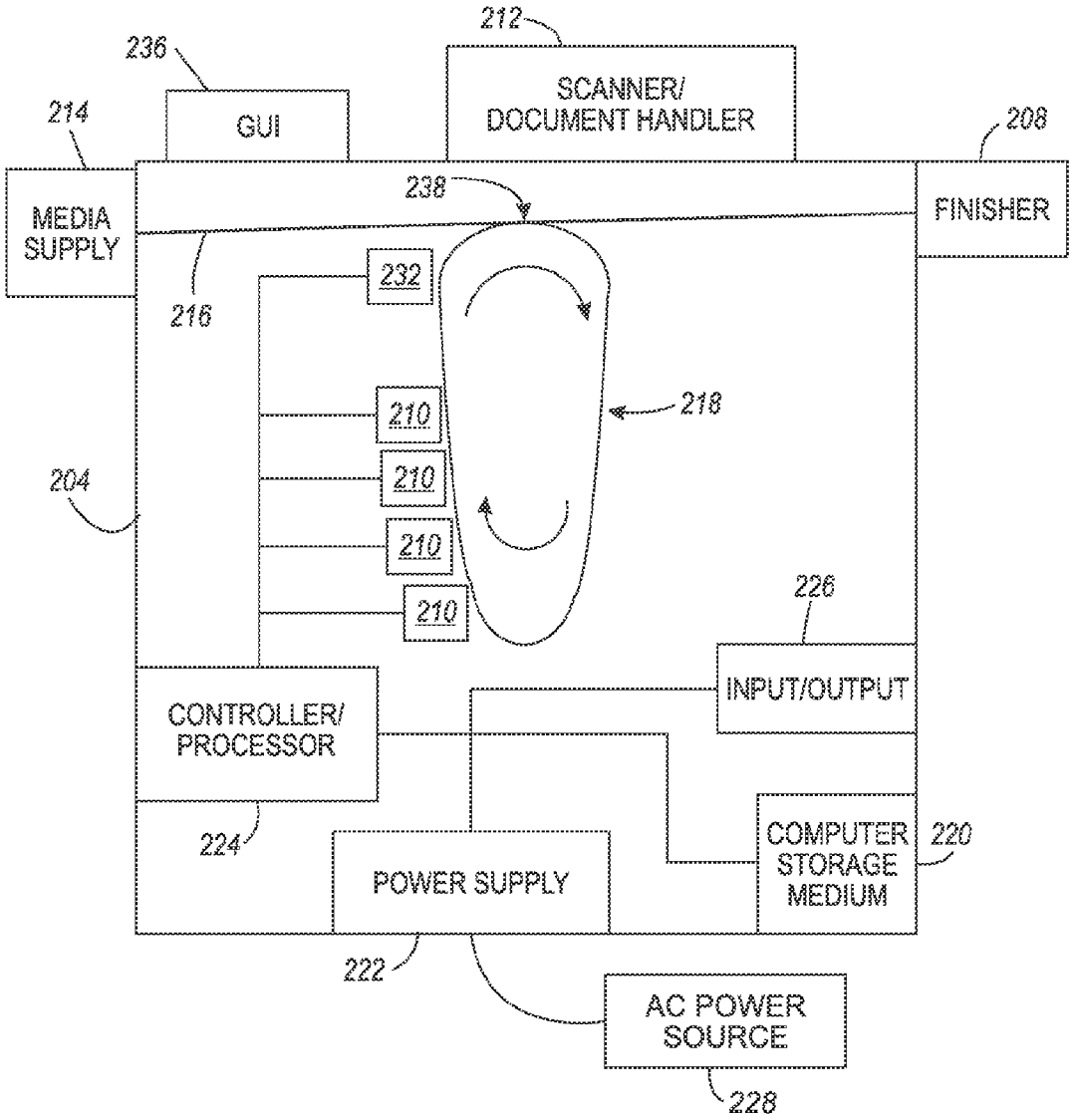
FIG. 3 is a schematic diagram illustrating devices herein.
Figure 4:
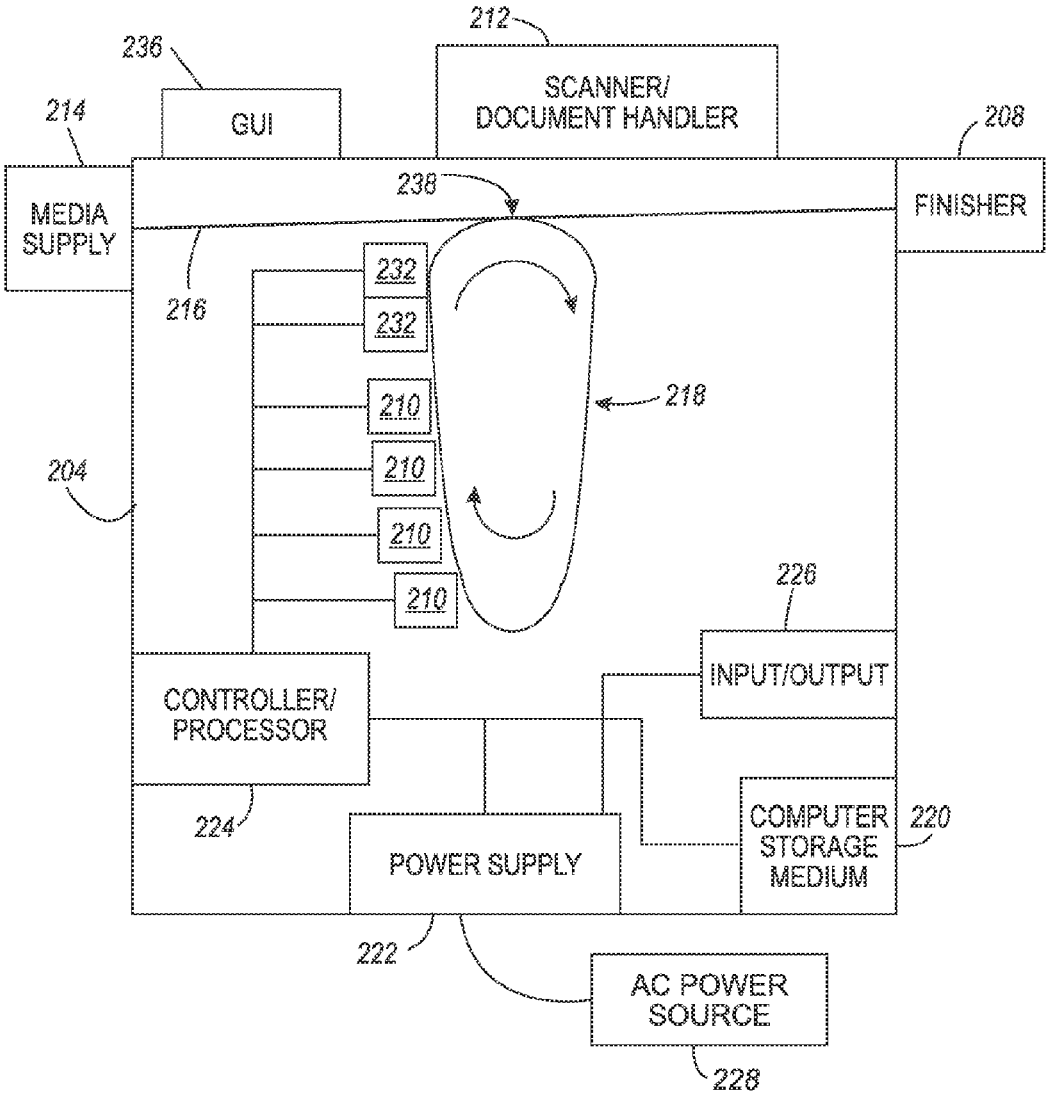
FIG. 4 is a schematic diagram illustrating devices herein.

FIG. 3 is a schematic diagram of a device herein that uses only a single electrostatic sensor 232, without the optical sensor 230. FIG. 4 is a schematic diagram of a device herein that uses multiple electrostatic sensors 232 that can be in any position that is before the transfer location 238 where the transfer surface 218 transfers marking material to the print media. The electrostatic sensor 232 is detecting the electrostatic voltage of the surface of the transfer surface 218 as opposed to the voltage of the marking material.

Figure 5:
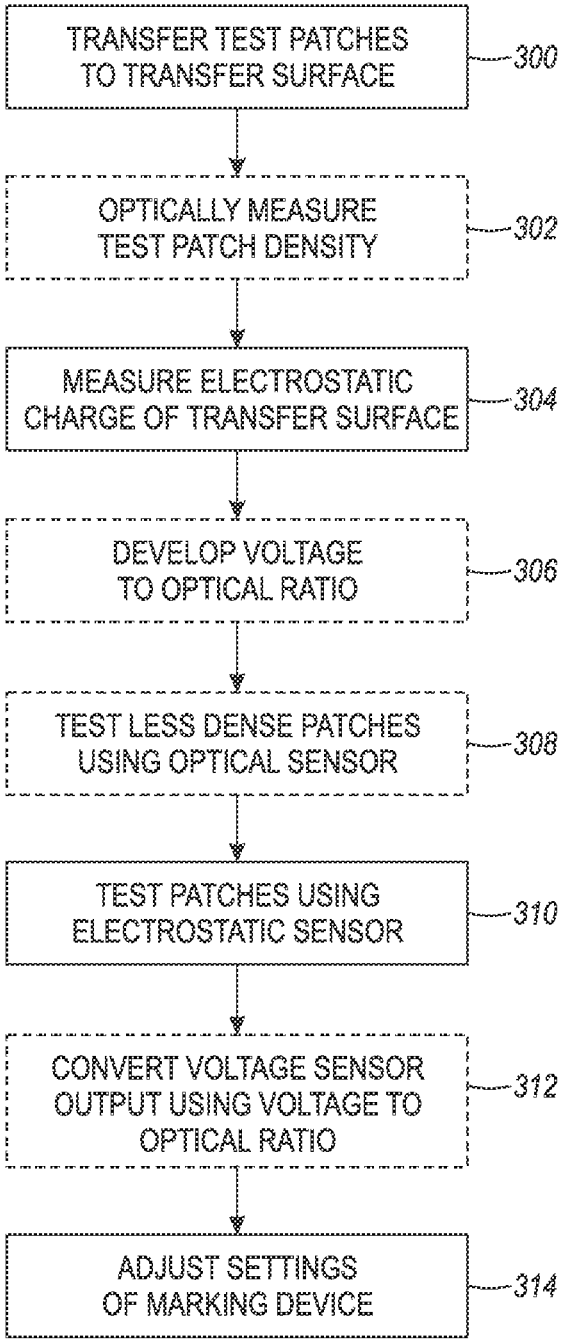
FIG. 5 is a flow diagram of various methods herein.

FIG. 5 is flowchart illustrating exemplary methods herein. In item 300, these methods transfer test patches of marking material from a marking device of a printing apparatus to a transfer surface of the printing apparatus. In item 302, these methods optionally optically measure the density of the test patches on the transfer surface using an optical sensor of the printing apparatus, and in item 304 measure the electrostatic differences in voltage of the transfer surface as the test patches on the transfer surface move past the electrostatic sensor of the printing apparatus. For example, such methods measure the electrostatic voltage in item 304 by detecting a voltage difference of the transfer surface with and without a test patch to determine an electrostatic value of each of the test patches.

As discussed above, different methods herein can use the electrostatic sensor alone to adjust the TRC, while other methods can use an optical sensor in combination with the electrostatic sensor (and use an electrostatic sensor response ratio when using the optical sensor). The flowchart in FIG. 5 therefore illustrates the processes that occur when the optional optical sensor is used as dashed-line boxes, indicating that such processes are not used in every embodiment described herein.

Such methods develop an "electrostatic sensor response" ratio between the electrostatic sensor response for a relatively more dense patch and a relatively less dense patch combined with a response of the optical sensor for the relatively less dense patch in item 306 (e.g., a halftone test patch) using a processor of the printing apparatus. Such methods test relatively less dense test patches using output from the optical sensor in item 308, and test relatively more dense test patches using output from the electrostatic sensor in item 310 (using the processor). The test patches comprise various densities of halftone test patches and solid test patches. The output from the optical sensor is used to test the relatively less dense test patches in item 308, and the output from the electrostatic sensor is used to test the relatively more dense test patches in item 310.

Such methods can convert the output from the electrostatic sensor into converted output using the electrostatic sensor response ratio in item 312, and adjust settings of the marking device based on a combination of the output from the optical sensor and the converted output from the electrostatic sensor in item 314 (using the processor). When adjusting the settings of the marking device in item 314, such methods determine a tone reproduction curve (TRC) for the marking device. Thus, when adjusting such settings of the marking device in item 314, these methods can change the charge level of a latent charge, discharge light level and/or bias voltage, etc.

Therefore, some structures and methods herein use an electrostatic sensor alone to detect differences in the electrical insulation value of a transfer surface as test patches of marking material are applied to the transfer surface to detect the density of the marking material within each test patch. Generally, the back side of the transfer surface is conductive and grounded to rollers which support and rotate the transfer surface. The voltage difference from ground seen on the opposite side of the transfer surface (the front side (or printing side) on which the test patches of marking material are placed) by the electrostatic sensor increases as the insulation value of the transfer surface increases. Thus, by detecting a higher voltage on the front side of the transfer surface, the devices and methods herein can determine that more marking material is present on the front side of the transfer surface.

The devices and methods herein can use the electrostatic sensor alone to determine the amount of marking material of all test patches transferred to the transfer surface. However, as the electrostatic sensor is most sensitive for the more dense test patches and an optical sensor is most sensitive for the less dense test patches, when the electrostatic sensor is used in combination with the optical sensor, performance is increased for all patch densities, without the need for interpolation.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the systems and methods described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes. Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A printing apparatus comprising:

a processor;

an intermediate transfer belt operatively connected to said processor;

a marking device operatively connected to said processor, said marking device comprising a photoreceptor and being adjacent said intermediate transfer belt and transferring test patches of marking material to said intermediate transfer belt; and an electrostatic sensor operatively connected to said processor, said electrostatic sensor being adjacent said intermediate transfer belt and measuring differences in charge of said intermediate transfer belt as said test patches on said intermediate transfer belt move by said electrostatic sensor, said test patches comprising halftone test patches and solid test patches.

2. The printing apparatus according to claim 1, said processor adjusting settings of said marking device by determining a tone reproduction curve (TRC) for said marking device.

3. The printing apparatus according to claim 1, said marking device further comprising a charging device operatively connected to said processor, said charging device forming a latent charge used to pattern said marking material, and said processor adjusting settings of said marking device by changing a charge level of said latent charge used by said marking device during printing.

4. The printing apparatus according to claim 1, said marking device forming said latent charge on said photoreceptor before developing said marking material on said photoreceptor and transferring said marking material to said intermediate transfer belt.

5. A printing apparatus comprising:

a processor;

an intermediate transfer belt operatively connected to said processor;

a marking device operatively connected to said processor, said marking device comprising a photoreceptor and being adjacent said intermediate transfer belt and transferring test patches of marking material to said intermediate transfer belt; and an electrostatic sensor operatively connected to said processor, said electrostatic sensor being adjacent said intermediate transfer belt and measuring differences in charge of said intermediate transfer belt as said test patches on said intermediate transfer belt move by said electrostatic sensor, said electrostatic sensor detecting a voltage difference, relative to ground, of said intermediate transfer belt with and without said test patches to determine an electrostatic value of each of said test patches.

6. A printing apparatus comprising:

a processor;

a transfer surface operatively connected to said processor;

a marking device operatively connected to said processor, said marking device being adjacent said transfer surface and transferring test patches of marking material to said transfer surface;

an optical sensor operatively connected to said processor, said optical sensor being adjacent said transfer surface and optically measuring density of said test patches on said transfer surface; and an electrostatic sensor operatively connected to said processor, said electrostatic sensor being adjacent said transfer surface and measuring differences in charge of said transfer surface as said test patches on said transfer surface move by said electrostatic sensor, said processor adjusting settings of said marking device based on a combination of output from said optical sensor and output from said electrostatic sensor, and said test patches comprising halftone test patches and solid test patches.

7. The printing apparatus according to claim 6, said output from said electrostatic sensor being used to test said solid test patches, and said output from said optical sensor being used to test said halftone patches.

8. The printing apparatus according to claim 6, said processor adjusting settings of said marking device by determining a tone reproduction curve (TRC) for said marking device.

9. The printing apparatus according to claim 6, said marking device further comprising a charging device operatively connected to said processor, said charging device forming a latent charge used to pattern said marking material, and said processor adjusting settings of said marking device by changing a charge level of said latent charge used by said marking device during printing.

10. The printing apparatus according to claim 6, said processor correlating said output from said optical sensor and said output from said electrostatic sensor using a relatively less dense patch comprising one of said halftone test patches.

11. A printing apparatus comprising:

a processor;

a transfer surface operatively connected to said processor;

a marking device operatively connected to said processor, said marking device being adjacent said transfer surface and transferring test patches of marking material to said transfer surface;

an optical sensor operatively connected to said processor, said optical sensor being adjacent said transfer surface and optically measuring density of said test patches on said transfer surface; and an electrostatic sensor operatively connected to said processor, said electrostatic sensor being adjacent said transfer surface and measuring differences in charge of said transfer surface as said test patches on said transfer surface move by said electrostatic sensor, said processor adjusting settings of said marking device based on a combination of output from said optical sensor and output from said electrostatic sensor, said electrostatic sensor detecting a voltage difference, relative to ground, of said transfer surface with and without said test patches to determine an electrostatic value of each of said test patches.

12. A printing apparatus comprising:

a processor;

a transfer surface operatively connected to said processor;

a marking device operatively connected to said processor, said marking device being adjacent said transfer surface and transferring test patches of marking material to said transfer surface;

an optical sensor operatively connected to said processor, said optical sensor being adjacent said transfer surface and optically measuring density of said test patches on said transfer surface; and an electrostatic sensor operatively connected to said processor, said electrostatic sensor being adjacent said transfer surface and measuring differences in charge of said transfer surface as said test patches on said transfer surface move by said electrostatic sensor, said processor developing an electrostatic sensor response ratio between said electrostatic sensor response for a relatively more dense patch of said test patches and a relatively less dense patch of said test patches combined with a response of said optical sensor for said relatively less dense patch, said processor testing relatively less dense test patches of said test patches using output from said optical sensor, said processor testing relatively more dense test patches of said test patches using output from said electrostatic sensor, said processor converting said output from said electrostatic sensor into converted output using said electrostatic sensor response ratio, and said processor adjusting settings of said marking device based on a combination of said output from said optical sensor and said converted output from said electrostatic sensor.

13. The printing apparatus according to claim 12, said electrostatic sensor detecting a voltage difference, relative to ground, of said transfer surface with and without said test patches to determine an electrostatic value of each of said test patches.

14. The printing apparatus according to claim 12, said test patches comprising halftone test patches and solid test patches, said output from said electrostatic sensor being used to test said solid test patches, and said output from said optical sensor being used to test said halftone patches.

15. The printing apparatus according to claim 12, said processor adjusting settings of said marking device by determining a tone reproduction curve (TRC) for said marking device.

16. The printing apparatus according to claim 12, said marking device further comprising a charging device operatively connected to said processor, said charging device forming a latent charge used to pattern said marking material, and said processor adjusting settings of said marking device by changing a charge level of said latent charge used by said marking device during printing.

17. The printing apparatus according to claim 12, said relatively less dense patch comprising a halftone test patch.

18. A method comprising:

transferring test patches of marking material from a marking device of a printing apparatus to a transfer surface of said printing apparatus;

optically measuring density of said test patches on said transfer surface using an optical sensor of said printing apparatus;

measuring differences in charge of said transfer surface as said test patches on said transfer surface move by an electrostatic sensor using said electrostatic sensor of said printing apparatus; and adjusting settings of said marking device based on a combination of output from said optical sensor and output from said electrostatic sensor, using a processor of said printing apparatus, said test patches comprising halftone test patches and solid test patches.

19. The method according to claim 18, said output from said electrostatic sensor being used to test said solid test patches, and said output from said optical sensor being used to test said halftone patches.

20. The method according to claim 18, said adjusting settings of said marking device comprising determining a tone reproduction curve (TRC) for said marking device.

21. The method according to claim 18, said adjusting settings of said marking device comprising changing a charge level of a latent charge produced by a charging device of said marking device during printing.

22. The method according to claim 18, further comprising correlating said output from said optical sensor and said output from said electrostatic sensor using a relatively less dense patch comprising one of said halftone test patches.

23. A method comprising:

transferring test patches of marking material from a marking device of a printing apparatus to a transfer surface of said printing apparatus;

optically measuring density of said test patches on said transfer surface using an optical sensor of said printing apparatus;

measuring differences in charge of said transfer surface as said test patches on said transfer surface move by an electrostatic sensor using said electrostatic sensor of said printing apparatus; and adjusting settings of said marking device based on a combination of output from said optical sensor and output from said electrostatic sensor, using a processor of said printing apparatus, said measuring differences in charge comprising detecting a voltage difference, relative to ground, of said transfer surface with and without said test patches to determine an electrostatic value of each of said test patches.

* * * * *